United States Patent [19]

Bidegain

[11] 4,397,387

[45] Aug. 9, 1983

[54] DISPLAY BOX

[75] Inventor: Georgy Bidegain, Morlaas, France

[73] Assignee: Embadac, Morlaas, France

[21] Appl. No.: 269,054

[22] PCT Filed: Oct. 8, 1980

[86] PCT No.: PCT/FR80/00146

§ 371 Date: May 29, 1981

§ 102(e) Date: May 29, 1981

[87] PCT Pub. No.: WO81/00996

PCT Pub. Date: Apr. 16, 1981

[30] Foreign Application Priority Data

Oct. 8, 1979 [FR] France ..... 79 24942

[51] Int. Cl.[3] ..... B65D 5/52

[52] U.S. Cl. ..... 206/45.23; 206/45.19; 206/45.31

[58] Field of Search ..... 206/45.13, 45.14, 45.18, 206/45.19, 45.20, 45.21, 45.22, 45.23, 45.28, 45.34; 220/284, 331, 335, 337, 355; 217/57, 58, 59; 229/44 M, 44 R

[56] References Cited

U.S. PATENT DOCUMENTS

| | | | |
|---|---|---|---|
| 561,384 | 6/1896 | Fletcher | 206/45.19 |
| 572,217 | 12/1896 | Rebmann | 220/337 |
| 1,518,219 | 12/1924 | Peter | 206/45.14 |
| 1,722,013 | 7/1929 | Oppenheim, Jr. . | |
| 2,240,645 | 5/1941 | Greig | 206/45.28 |
| 2,353,522 | 7/1944 | Stern | 206/45.19 |
| 2,415,357 | 2/1947 | Kucki | 220/331 |
| 2,491,264 | 12/1949 | Hermani . | |
| 2,525,728 | 10/1950 | Sauer | 206/45.13 |
| 2,867,348 | 1/1959 | Morrison | 220/331 |
| 2,880,858 | 4/1959 | Persky . | |
| 3,168,192 | 2/1965 | Nicholson et al. | 206/45.28 |
| 3,545,111 | 12/1970 | Spiegel et al. | 206/45.31 |
| 3,630,344 | 12/1971 | Bergh et al. | 206/45.14 |
| 3,684,084 | 8/1972 | Kanzelberger | 206/45.31 |
| 3,741,430 | 6/1973 | Bergh et al. | 220/38 |
| 3,850,342 | 11/1974 | Dsjuba | 220/331 |
| 4,238,049 | 4/1979 | Lehmann et al. | 220/331 |
| 4,369,879 | 1/1983 | Egly et al. | 206/45.18 |

FOREIGN PATENT DOCUMENTS

| | | |
|---|---|---|
| 2208544 | 9/1972 | Fed. Rep. of Germany . |
| 718765 | 1/1932 | France . |
| 762346 | 4/1934 | France . |
| 1028576 | 5/1953 | France . |
| 1142823 | 9/1957 | France . |
| 1149620 | 12/1957 | France . |

*Primary Examiner*—Joseph Man-Fu Moy
*Attorney, Agent, or Firm*—Young & Thompson

[57] ABSTRACT

A display box comprising a base provided with a sidewall, and a hollow cover pivotally mounted on one end face of the sidewall of the base by pivot members, the base and the cover constituting two separate parts, the pivot members comprising two protruding pins integral with one of the parts, and two oval holes in the other of the parts for receiving the pins. The base (1) comprises a lower peripheral flange (13) connected to the lower part of its sidewall (12) on which rests the cover (2) in a closed position and an opening in the region of said end face (121)in the vicinity of the flange for avoiding any blocking of the cover before it attains its open position. The box is applicable to the packaging and the display of luxury articles such as perfumery articles.

11 Claims, 4 Drawing Figures

DISPLAY BOX

The present invention relates to display boxes, notably display boxes intended for packaging and display of luxury articles such as perfumery articles.

An object of the invention is to devise a display box having a smart appearance and good sturdiness while being of easy manufacture and low cost price owing notably to the possibility of manufacturing the box with the help of machines with a minimum of manual intervention.

To this end the invention relates to a display box of the type comprising a base adapted to receive an article to be displayed and provided with a sidewall and a lower peripheral flange, and a hollow cover, the hollow cover being pivotally mounted on an end face of the sidewall of the base between a closed position in which it rests against the peripheral flange thereof surrounding its sidewall and an open position in which it disengages at least partially the base while permitting the displayed article to be seen, the display box being characterized in that the base and the cover comprise two separate parts, the pivot members comprising on the one hand two protruding pins integral with one of said parts, on the other hand two holes or through slots for receiving said pins formed in the other of said parts, and means for permitting opening of the box comprising an ovaling of said holes, that is, their formation as slots, and an opening in the region of said end face of the sidewall of the base at least in the vicinity of said flange. This structure permits the sought advantages to be obtained and an easy maneuvering of the box toward the open or closed position.

In a particular embodiment, the protruding pins are integral with the base and the two holes are formed in the cover.

According to interesting features of the invention the base comprises a support provided with a sidewall having an opening in the region of an end face and a lower peripheral flange, and a frame provided with a sidewall having two protruding pins and also an opening and an upper inwardly folded flange, the sidewall of the frame surrounding the sidewall of the support, and a plate provided with at least one window forming the receptacle for the article to be displayed, said plate being maintained at the upper part of the support between the support means such as vertical ribs integral with the interior part of the sidewall of the support and the upper flange of the frame, while the cover comprises an inner element provided with ovaled holes, that is, through slots adapted to receive the pins on the base, whose length is at least approximately equal to the length of the pins of the base, and an outer element covering the inner wall element which is nonperforate at the location of the holes. This design of the base permits the packaging of a wide variety of articles with the help of only several types of base; the design selected for the cover itself permits a great diversity of display as a function of the nature and appearance of the outer wall element used.

The features and advantages of the invention will moreover be brought out in the description which follows, with reference to the accompanying drawings, in which.

Figure 1:
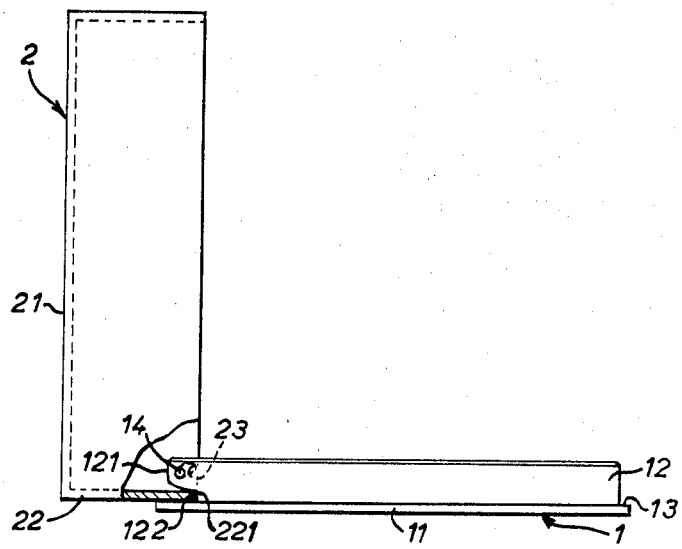
FIG. 1 is a side view of a display box according to the invention shown diagrammatically, in the open position, a region of the cover being cut away to show the general shape of the base.
Figure 2:
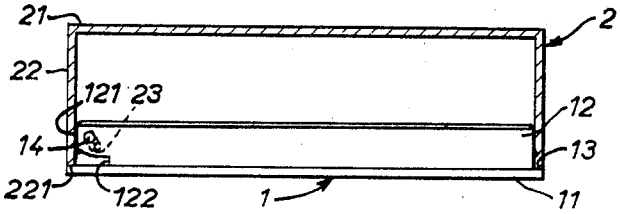
FIG. 2 is a side view of the same display box shown diagrammatically, in the closed position, the cover being shown in longitudinal section.

The display box of the invention shown diagrammatically in FIGS. 1 and 2 comprises a base 1 intended to receive an article to be displayed and a hollow cover 2 made of two separate parts.

The base 1 itself comprises a base plate 11 and a sidewall 12 placed on the base plate 11, and of slightly smaller dimensions than it, so that a peripheral flange 13 is defined along the perimeter of the base plate 11; the base plate here is of rectangular shape, and the general shape of the sidewall is therefore also rectangular; proximate to one of the ends of the sidewall 12 are two pins 14 protruding outwardly from the wall respectively on both sides of the base; these two pins 14, here cylindrical, placed proximate to an end face 121 of the sidewall 12 are located in the continuation of each other to determine an axis about which the cover 2 is pivotally mounted with respect to the base 1, between a closed position in which it rests against the peripheral flange 13 while surrounding the sidewall 12 (i.e., where it snugly covers the base 1) and an open position in which it permits the displayed article to be seen and in which for this purpose it disengages the base 1 except in the region of the pivot axis.

The cover 2 comprises a top 21 and a sidewall 22 which, being adapted in the closed position to snugly cover the base 1, has the same general shape as the sidewall 12 of said base, with the interior dimensions hardly greater than the exterior dimensions of the sidewall 12. In order to receive the protruding pins of the sidewall 12 of the base 1, the sidewall 22 of the cover 2 has two through slots or ovaled holes 23.

Nevertheless it is necessary to provide appropriate additional means for opening the box. In particular, in order that the cover 2 may not be hindered by the base 1 in its pivoting with respect to the same following the blocking of the lower edge 221 of the sidewall 22 by the base plate 11 in the region of the end face 121 proximate to which are the pins 14, an appropriate means may consist in that this pivoting does not reduce to mere rotation, but is constituted by rotation accompanied with a slight translation of the two parts one relative to the other; further, in order that the cover 2 may not be hindered by the base 1 following the blocking of the lower edge of the side wall 22 of the cover 2 by the sidewall 12 of the base 1, an appropriate means may consist in that the sidewall 12 of the base 1 has an opening in the region of the end face 121 at least in the vicinity of the peripheral flange 12. Practically speaking, the translation accompanying the rotation of the cover 1 with respect to the base 2 is obtained by an ovaling of the holes 23, the axis of the oval being inclined downwardly and towards the front of the display box when the latter is in its closed position, the cover 2 bearing against the base 1; the opening in the region of the end face 121 is located over the entire length thereof at its lower part, and continues to the rear part of the two faces of the sidewall 12 of base 1 which are joined thereto; in order to stop the movement of the cover 2 to an open limit position it is possible to provide on each one of the faces on which the opening is continued, an abutment edge 122 for the lower edge 221 of the sidewall of the cover 2, in order that this position may be stable even when the box is inclined, it may also be provided that the width of the faces at this location is greater than a minimum appropriate value.

Since the cover 2 is provided of relatively flexible material, the mounting of the cover 2 on the base 1 is effected simply by force, by moving apart its sidewall 22 and leaving the sidewall resume its shape when the pins 14 are engaged in said holes 23; the opening of the box is done by making the cover 2 undergo a slight upwards translation at the same time as rotation with respect to the base 1.

Figure 3:
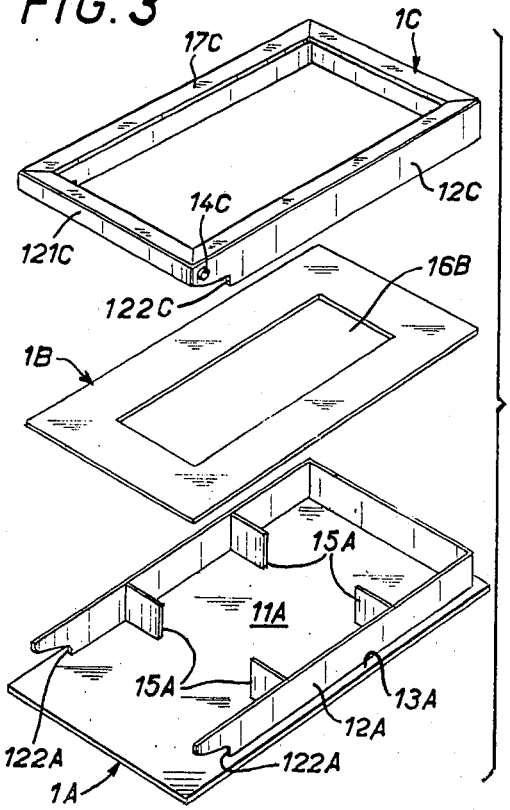
FIG. 3 shows in perspective the three parts constituting the base in the preferred embodiment of the invention.

In the embodiment shown in FIG. 3, the base 1 comprises a support 1A, a plate 1B and a frame 1C.

The support 1A comprises a base plate 11A and a sidewall 12A here having a generally rectangular configuration, but having only three faces, the location of the fourth face being totally freed by the opening intended to permit opening of the box; further, the two faces delimiting the location of the eliminated end face each comprise a notch thus continuing the opening along the lower part of these two faces, this notch being limited by an abutment edge 122A. Since the exterior dimensions of the sidewall 12A are smaller than those of the base plate 11A, the support comprises a peripheral flange 13A having preferably a width the thickness of the cover so that there is no overhanging part. The sidewall 12A also comprises vertical ribs 15A integral with its lower part and the base plate 11A; these vertical ribs adapted to support the plate 1B may extend for example perpendicularly to the faces with which they are integral. The support 1A may be of any relatively rigid material, but for most applications, plastic materials or cardboard are particularly suitable, notably, polystyrene, taking into account the low cost of manufacture they involve; this piece may be manufactured for example by injection.

The plate 1B, adapted to position the article to be displayed, comprises here for this purpose, where the box is intended for packaging and display of a single article having a rectangular contour, a window 16B forming a receptacle for this article; or course, the window 16B may have any shape adapted to the article or articles to be displayed, and the plate 1B may comprise plural windows if the article so requires, or also if the display box is intended to contain a plurality of articles. This plate 1B may be of any nearly rigid material as a function of the desired appearance, for example of cardboard or plastic material whether injected or not.

The frame 1C comprises a sidewall 12C itself also having a generally rectangular configuration, of dimensions slightly greater than those of the sidewall 12A of the support 1A in order to be able to be immobilized therearound; this sidewall here comprises four faces, but the end face 121C corresponding to the location of the fourth face totally freed by the opening of the sidewall 12A of the support 1A is provided with an opening at its lower part; further, the sidewall 12C of the frame 1C comprises on its two faces adjacent its end face 121C, a notch continuing the opening in this end face 121C along the lower part of these two faces, this notch being limited by an abutment edge 122C; of course, it is possible to provide that only the sidewall 12A of the support 1A or only the sidewall 12C of the frame 1C comprises an abutment edge. The faces adjacent the end face 121C each comprise a pin 14C proximate to this end face, these pins, as seen in this part of the description relative to FIGS. 1 and 2, protruding outwardly and situated in the continuation of one another. In order that the plate 1B may be held in the base 1 without escaping upwards the frame 1C comprises an upper flange 17C folded inwardly. This frame 1C may also be of plastic material, for example, injected, or of any other suitable material such as cardboard.

The mounting of the base 1 is particularly simple since it suffices to place the plate 1B on the support 1A, then slide the frame 1C around the sidewall 12A of the support 1A, its upper flange 17C consequently being opposite the peripheral flange 13A of the support 1A. It may be provided to fix by any appropriate means, for example, by glueing, welding or detenting the frame 1C to the support 1A, or even not to fix these two pieces to each other notably if their fit is sufficiently snug; when these two pieces are immobilized relative to each other, the plate 1B is maintained in position at the upper part of the support 1A.

Figure 4:
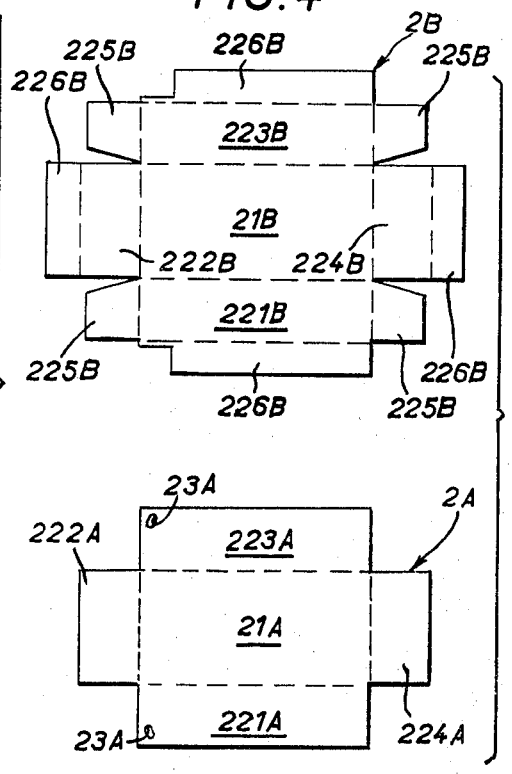
FIG. 4 shows a top view of the two elements constituting the cover in a preferred embodiment of the invention, before forming the cover by folding.

In the embodiment shown in FIG. 4, the cover 2 comprises an inner element 2A and an outer element 2B adapted to overlay it, giving it the desired appearance.

The inner element 2A is a "blank" made from a sheet, here of cardboard of cross shape whose central part 21A is intended to constitute the top, and the arms 221A, 222A, 223A, 224A intended to constitute the sidewall; in order that once the arms are folded along the broken line in FIG. 4, the cover may snugly cap the base, the central part 21A has dimensions slightly greater than the exterior dimensions of the sidewall of the base; in order that the sidewall of the inner element 2A may have a constant height, the four arms 221A, 222A, 223A, 224A have the same length, greater than the height of the sidewall of the base as a function of the article that the box is intended to receive. Two opposed arms of the cross are provided symmetrically with through slots or holes 23A ovaled so that once the arms are folded, the cover may pivot as described in the part of the description relative to FIGS. 1 and 2. The thickness of the sheet is at least approximately equal to the length of the pins, here of the order of 1.3 millimeter, when there is an outer element 2B covering even the ovaled holes 23A; they may be smaller than in the contrary case.

The outer element 2B is a "blank" made from a sheet, in general thinner, here of a paper-plastic material complex about several tenths of a millimeter thick, having the same cross section as the sheet constituting the inner element 2A, but further comprising foldable flaps. Thus, the outer element 2B has a central part 21B and four arms 221B, 222B, 223B, 224B; at least two arms 221B, 223B comprise side tabs 225B (here two side tabs per arm) and the arms also comprise end tabs 226B. Whereupon, after folding the inner element 2A, since the four arms being folded perpendicularly to the central part so that their edges face one another in pairs, the outer element 2B coated with an adhesive on one side, at least in the region of the foldable tabs, is glued to the element 2A on the outside thereof; the end tabs 226B which are adapted to be glued to the arms of the inner element 2A provided with ovaled holes 23A have a notch in this region, in such a manner that the holes 23A are closed off only on the outer face of the cover 2 in order to permit the passage of the pins 14.

Generally speaking it is necessary that the pins 14 not be too close to the end face 121 of the sidewall 12 and the peripheral flange 13 of the base 1 in order that the ovaled holes 23 of the cover may not be too close to the edges of said cover to avoid tears in the cover.

Of course the invention is not limited to the shape and the embodiment described and shown above, and other shapes and embodiments may be provided; for example, a cover of a single element may be provided, or even, whereas the above described shape comprised a base provided with a peripheral flange permitting the box to be easily wrapped in cellophane automatically, a much greater or on the contrary nonexistent peripheral flange may be provided without departing from the scope of the invention. Likewise, in the illustrated example, the cover is hinged on the base parallel to the short side, but an articulation parallel to the long side may just as well be provided or any other appropriate fashion.

I claim:

1. Display box comprising a base adapted to receive an article to be displayed and having an upstanding sidewall, and a hollow cover, the base and the cover comprising two separate parts, means pivotally mounting said cover at the rear on said base for swinging movement between a closed position in which said cover surrounds said sidewall and an upright open position in which it at least partially disengages said base for permitting the article to be viewed, said means pivotally mounting said cover comprising two laterally protruding pins integral with one of said parts and two complementary through slots for receiving said pins formed in the other of said parts, said base having a substantially flat lower peripheral flange joined to and extending outwardly from under said sidewall, said lower peripheral flange being in engagement with the free edge of said cover in the closed position of said cover substantially along the entire flange, there being an opening extending along a rear wall portion of said sidewall and into rear parts of lateral wall portions of said sidewall adjacent said flange for permitting said cover to be pivoted to its open position in which the outer surface of the rear of said cover bears along a corresponding portion of said peripheral flange.

2. Display box according to claim 1, wherein said protruding pins are integral with said base and said slots are formed in the cover.

3. Display box according to claim 11, wherein said base comprises a support including a sidewall with an open rear end and a base plate defining said lower peripheral flange, and a frame including a sidewall, said protruding pins being integral with said frame sidewall, and an inwardly folded flange extending from the upper edge of said frame sidewall, said frame sidewall surrounding said support sidewall and defining said base sidewall.

4. Display box according to claim 3, wherein the width of said peripheral flange is substantially equal to the thickness of the portion of said cover surrounding said base sidewall.

5. Display box according to claim 3, wherein said base further comprises a plate having at least one window defining a space for receiving the article to be displayed, said plate being sandwiched between the upper edges of vertical ribs connected to said support sidewall and said inwardly folded flange of said frame.

6. Display box according to claim 1, wherein said cover comprises an inner element in which said through slots are formed, the thickness of the portion of said inner element surrounding said through slots being substantially equal to the length of said pins, and an outer element covering said inner element in nonperforate in line with said slots in said inner element.

7. Display box according to claim 1, wherein said base is made of injected plastic material.

8. Display box according to claim 7, wherein said cover is made at least in part of cardboard.

9. Display box according to claim 1, wherein said opening extends along the entire rear wall portion of said base sidewall for receiving the corresponding lower margin of the rear wall of said cover in said open position.

10. Display box according to claim 1, wherein an abutment edge is formed by the forward end of said opening in the rear parts of said lateral wall portions for engagement with the edge of the rear wall of said cover in the open position.

11. Display box according to claim 1, wherein said opening in the rear parts of said lateral wall portion is sized to maintain said cover in its open position even when the box is inclined.

* * * * *